United States Patent [19]

Kraklau

[11] 4,086,953

[45] May 2, 1978

[54] SHOT SLEEVE

[76] Inventor: David M. Kraklau, 1901 Lassin, St. Joseph, Mich. 49085

[21] Appl. No.: 734,873

[22] Filed: Oct. 22, 1976

Related U.S. Application Data

[63] Continuation-in-part of Ser. No. 552,775, Feb. 24, 1975, abandoned.

[51] Int. Cl.[2] ..... B22D 17/12

[52] U.S. Cl. ..... 164/312; 425/547

[58] Field of Search ..... 164/303, 306, 309, 311, 164/312, 313, 316, 317; 425/547, 548, 549

[56] References Cited

U.S. PATENT DOCUMENTS

| | | | |
|---|---|---|---|
| 1,321,457 | 11/1919 | Kralund | 164/306 X |
| 3,516,480 | 6/1970 | Woltering | 164/312 |
| 3,685,572 | 8/1972 | Carver et al. | 164/312 |
| 3,872,913 | 3/1975 | Lohikoski | 164/82 X |

*Primary Examiner*—Francis S. Husar
*Assistant Examiner*—Gus T. Hampilos
*Attorney, Agent, or Firm*—Blanchard, Flynn, Thiel, Boutell & Tanis

[57] ABSTRACT

A shot sleeve assembly for a die casting machine having an outer cooling sleeve adapted to be mounted on one of the machine platens. An inner shot sleeve is positioned within the outer sleeve and communicates with the cavity of the die assembly mounted on the platen. The outer diameter of the inner shot sleeve is slightly smaller than the inner diameter of the outer cooling sleeve when the sleeves are at substantially the same temperature. The outer sleeve has a plurality of cooling passages extending axially thereof through which circulates a cooling fluid so that the outer sleeve remains at a substantially lower temperature than the shot sleeve when the die casting machine is in operation. The molten material which is supplied to the shot sleeve for subsequent supply to the die cavity causes the shot sleeve to heat up to a relatively high temperature and expand. Since the outer sleeve is cooled and maintained at a substantially lower temperature, the inner sleeve expands to create engagement thereof with the outer sleeve. However, when the machine is nonoperational and is at substantially room temperature, the inner shot sleeve can be slidably removed from the back or rear side of the platen without requiring removal of the outer sleeve.

8 Claims, 6 Drawing Figures

SHOT SLEEVE

CROSS REFERENCE TO RELATED APPLICATION

This application is a continuation-in-part of application Ser. No. 552,775 filed Feb. 24, 1975, now abandoned.

FIELD OF THE INVENTION

This invention relates to a die casting machine and, more specifically, to an improved shot sleeve assembly adapted for use on a die casting machine.

BACKGROUND OF THE INVENTION

The die casting industry is an old and well-established industry which has, in recent years, experienced growth into an ever-increasing range of die cast products. This growth, however, is believed to have been severely restricted by the large number of complex and seemingly interrelated problems which have long been experienced in this industry. Many of these problems have never been adequately solved and, at best, are normally attacked solely on an individualized trial-and-error basis. This results in this industry operating at substantially less than maximum efficiency, which thereby greatly increases the cost of products produced by this process, and also severely restricts the applicability of this process to different products.

One area which has long presented a problem in the die casting industry relates to the die. For example, the proper filling of the die has long been a serious problem, and monitoring the filling of the die is basically a trial-and-error procedure which, when solved, is then repetitively followed during production. The die area has also presented a serious problem with respect to proper determination of the minimum time required for solidification of the metal in the die so as to ensure that the die can be separated within the shortest possible time, thereby permitting maximum rate of production. At the same time, it is necessary to avoid separation prior to solidification of the metal, since this not only destroys the cast part but also often causes a freeze-up of the machine which requires substantial machine maintenance prior to placing the machine in condition for further operation.

Another area which has long plagued the die casting industry relates to the die casting apparatus and specifically the shot sleeve assembly. The shot sleeve assembly has, for the most part, been substantially ignored by the die casting industry, even though this assembly has long presented a serious problem with respect to wear, maintenace and replacement. Since problems relating to the shot sleeve assembly are normally not caused by a single factor or condition, but rather are the result of numerous interrelated complex factors, the industry has accordingly accepted these problems and has thus accepted a performance level substantially less than optimum. For example, the die casting industry normally accepts these problems and solves same by tolerating substantially short life in these assemblies, which requires replacing or reworking these assemblies on a frequent basis in order to keep the die casting machine in operation. While various attempts have been made at improving the shot sleeve assembly, most of these attempts have concentrated on trying to solve one specific problem or factor as it relates to the overall assembly. Because of this, these attempts have resulted in structures which have been far less than satisfactory and have not provided a complete solution to the problem, since these attempts have failed to take into account the numerous interrelated and rather complex factors which influence the design of a successful shot sleeve assembly.

The specific problems experienced with the shot sleeve assembly, which problems have existed for many years, are briefly summarized as follows:

1. Cracking: Since a substantial quantity of extremely hot molten metal is intermittently deposited into the shot sleeve assembly, this causes substantial heating of the sleeve, which heating is highly nonuniform both circumferentially and radially of the sleeve due to (1) the irregular positioning of the material within the sleeve and (2) the manner in which the material is deposited in the sleeve and then pushed into the die cavity. This results in severe temperature gradients within the sleeve, which in turn induces severe thermal stresses. These stresses can result in severe thermal cacking of the sleeve, which cracking often takes the form of surface cracks or, in the extreme, causes a crack throughout the radial wall of the sleeve which may extend partially or totally through the axial extent thereof. This cracking obviously destroys the sleeve, which destruction often takes place after a relatively small number of cycles.

2. Sleeve wear: The sleeve often experiences substantial wear in the internal surface thereof directly opposite the pour hole. This wear occurs due to an erroding of the sleeve material due to the thermal tempering and resulting abrasion of the sleeve directly opposite the pour hole. This results in an enlargement of the interior of the sleeve, which thereby requires a reworking or reboring of the sleeve. This changes the volume of the sleeve and necessitates the provision of a new enlarged tip member. This also effects the volume of the chamber and the quantity of molten metal being injected into the die cavity.

3. Tip wear: The plunger tip which is slidable within the sleeve also experiences substantial wear and requires frequent replacement, normally at intervals even more frequent than the sleeve. Tip wear is compounded by the wear of the sleeve, as discussed above, which often permits metal deposits to collect within the sleeve. These metal deposits abrasively score the surface of the tip, particularly the leading edge thereof. The wear of the tip, or any significant increase in clearance between the tip and the sleeve, also creates a potentially dangerous operational condition in that the hot molten metal can blow back around the tip and be discharged into the surrounding environment, thereby creating a hazard to the operating personnel.

4. Distortion: The thermal stresses induced in the sleeve by the hot molten metal, as discussed above, also result in substantial distortion of the sleeve. This distortion is of two types, the first being circumferential in that it causes the sleeve to assume an out-of-round shape, and the second being axial in that the sleeve assumes a bowed or "banana" shape. This greatly increases the wear of the sleeve, and particularly the tip since it is normally constructed of a softer material such as berylliumcopper. This also seriously effects the desired clearance between the tip and the sleeve, which increases the possibility of material blow-by.

5. Replacement: The replacement of the sleeve, as required by excessive wear or breakage, is extremely laborious and time-consuming. Many sleeves are mounted on the die platen by being inserted into the platen from the die side. This requires removal of the die prior to gaining access to the sleeve. Since removal of the die is both laborious and time-consuming, and normally involves the utilization of a fork lift truck and requires anywhere from several hours to several days, this replacement operation is obviously very inefficient and costly. Further, the sleeve often seizes within the platen due to thermal distortion. This thus makes removal of the damaged sleeve extremely difficult.

6. Clearance: The clearance between the interior bore of the sleeve and the cylindrical tip member slidably disposed therein is critical if efficient operation of the die casting machine is desired for long periods of time. This clearance must be maintained at a minimum to prevent the blow-by of molten metal past the tip member, which is obviously undesirable as explained above. In addition, if this clearance becomes excessive, then the molten metal causes rapid wear and errosion of the tip member, which not only further increases the clearance but also greatly shortens the life of the tip member. At the same time, suitable clearances must be maintained to permit free sliding movement of the tip member. Due to the substantial temperature changes experienced by the sleeve, and the nonuniform thermal distortions which occur therein, maintaining a proper clearance between the sleeve and the tip member has, heretofor, been substantially impossible. The maintaining of a desired clearance has been further complicated by the fact that, for many years, it has been a conventional practice to cool the tip member by continuously circulating a liquid coolant (such as water) therethrough. While this maintains the tip member at a lower and more uniform temperature, nevertheless none of the prior structures have been able to provide a similar optimum uniform cooling of the sleeve. Thus, maintaining the desired substantially uniform clearance between the sleeve and the tip member has been substantially impossible.

While various attempts have been made to improve the design of the shot sleeve assembly, nevertheless most of these prior attempts have concentrated on only one or two of the specific problems which have been explained above. These prior attempts, while possibly slightly improving the shot sleeve assembly, have nevertheless failed to greatly improve this structure since they have failed to take into account the overall interrelationship of the above-mentioned numerous problems.

For example, U.S. Pat. No. 3,209,416 discloses a shot sleeve assembly for a die casting machine which is provided with an annular groove therearound for receiving a coolant. The shot sleeve is of a one-piece structure and the annular coolant groove is closed by a wall formed on the lower die platen. This shot sleeve assembly, however, fails to solve the numerous problems mentioned above since the coolant is concentrated solely within the small annular groove which is located adjacent the middle of the sleeve. There is no cooling of the end portions of the sleeve, so that the cooling is thus very nonuniform in the axial direction of the sleeve. This accordingly results in substantial thermal gradients and stresses in the sleeve which induce nonuniform distortion, whereby the desired clearance between the tip member and the sleeve is accordingly destroyed. At the same time, this one-piece cooled sleeve is subject to substantial thermal cracking since the sleeve is directly contacted not only on the inside thereof by the hot molten metal, but is also directly contacted on the outside thereof by the coolant. This direct contact of the same one-piece sleeve by both the molten metal and the coolant results in extreme thermal gradients radially through the wall of the sleeve, which makes the sleeve very prone to cracking. This type of cooling arrangement is also difficult to control with respect to the desired amount of cooling since, by permitting the coolant to directly contact the sleeve containing the molten metal, this arrangement permits extracting too much heat from the molten metal, which thereby requires that the molten metal be deposited into the sleeve at a higher temperature, or in the alternative results in excessive cooling of the molten metal so that the desired fluidity thereof is reduced resulting in improper filling of the die cavity. This sleeve is also subject to the problem of seizing within the platen since the end portions can still thermally expand through undesired amounts and thermally distort a sufficient amount to seize the die platen.

U.S. Pat. No. 3,516,480 discloses another attempt to overcome the above problems by providing a cooled shot sleeve assembly. In the structure of this patent, the assembly is formed by utilizing an outer cooled sleeve having an inner sleeve (or liner) snugly fit therein. The outer sleeve has a narrow cooling insert extending axially thereof adjacent the very bottom of the outer sleeve. The shot sleeve assembly of this patent, however, also fails to provide an effective solution to the numerous problems which have been outlined above. To begin with, the cooling in this sleeve assembly is concentrated in a narrow axially extending region along the bottom of the outer sleeve, so that there is not proper cooling circumferentially around the sleeve. This thus results in the heat being extracted solely adjacent the bottom of the sleeve assembly, whereby severe thermal gradients are set up circumferentially of the sleeve. This subjects the sleeve assembly to severe distortions which cause it to assume an axially bowed and/or an out-of-round shape. This makes the inner sleeve or liner subject to cracking, particularly splitting in the longitudinal direction thereof due to the concentration of the cooling along the narrow axially extending region. Since the outer sleeve is also subject to substantial expansion and distortion, it is also subject to splitting or at least separating from the cooling insert. This sleeve arrangement also results in the clearance between the liner and the plunger tip being substantially increased in a nonuniform manner due to the nonuniform expansion of the sleeve assembly, thereby destroying the desired clearance between the tip and the liner, which in turn greatly increases the rate of tip wear.

U.S. Pat. No. 3,685,572 discloses a modified shot sleeve assembly which is of a multi-part construction provided with limited clearances between portions of some parts to permit limited radial expansion therebetween. While the shot sleeve assembly of this patent does attempt to control the thermal distortion of the shot sleeve assembly, nevertheless the control achieved by this structure is far less than that required in order to result in optimum performance and life of the shot sleeve assembly and the associated tip member. For example, the shot sleeve assembly of this patent discloses that the clearances between the inner and outer sleeves need extend over only part of the axial length of the sleeves. This, however, is totally undesirable since these sleeves are still in snug engagement with one another at the opposite ends whereby undesired thermal stresses and hence nonuniform thermal distortions still occur. This patent thus does not recognize the need to provide such clearances axially throughout the complete length of the sleeve in order to provide optimum control over the thermal stresses and distortions of the sleeve assembly. Absent this optimum control, the desired uniform clearance between the tip and the liner is accordingly not maintained throughout the axial length of the assembly. In addition, the shot sleeve assembly of this patent does not recognize the need for cooling the liner assembly, and hence this assembly results in undesired heating which causes excessive thermal stresses and distortions of the sleeve assembly. In addition, this shot sleeve assembly utilizes an outer casing which must be positioned in the die platen from the die side thereof, and in fact this outer casing is bolted directly to one of the dies. Thus, any seizing or cracking of the shot sleeve assembly requires a complete shutdown of the machine and removal of the dies in order to permit removal of the outer casing. Further, the shot sleeve assembly of this patent is formed from a large number of different sleeve members, and in fact utilizes several different sleeve members in coaxial alignment with one another. Due to the different thermal stresses and distortions throughout the axial length of the sleeve assembly, the use of these different axially aligned sleeve members can compound the wear of the tip member due to the different expansions experienced by the different liner members, resulting in undesired edges or corners along the sleeve bore. These mating corners or edges are also subject to collecting metal deposits which also greatly accelerates the tip wear. Thus, the shot sleeve assembled of this patent does not take into account the numerous complex and interrelated factors which must be considered in designing a shot sleeve assembly to effectively overcome or at least compensate for the numerous problems mentioned above.

At the present time, most die casting machines are totally or at least partially manually controlled, and most often utilize either manual filling of the shot sleeve with molten metal, or utilize ladling apparatus which is manually controlled. Thus, most die casting machines thus operate at less than maximum capacity since they are limited with respect to the manual rate at which the operation can be carried out. Nevertheless, even though this rate of production is limited due to the control conditions which are effected by manual manipulations, nevertheless the above-mentioned problems are still encountered repetitively and at a rather frequent rate, which thus results in the production capacity of the machine being still further impaired. At the present time, however, the use of automatic ladling equipment is becoming more common and this equipment does, theoretically, permit the production rate to be substantially increased. However, any such increase in the production rate by use of automatic ladling equipment causes the heating of the shot sleeve assembly to become even more severe, so that the above-mentioned problems become even more pronounced. Thus, mere utilization of automatic ladling equipment or the like has not had a significant impact on the efficient utilization of the die casting machine since it merely accelerates the failure of the shot sleeve assembly due to one or more of the above-mentioned problems.

Accordingly, it is a primary object of the present invention to provide an improved shot sleeve assembly for a die casting machine, which shot sleeve assembly attempts to take into account the many interrelated factors which effect this assembly so as to at least partially solve, or at least improve upon, most of the many different problems discussed above. Further, the shot sleeve assembly of this invention represents a substantial improvement over the structures disclosed in the above-mentioned patents, by eliminating or at least substantially minimizing the disadvantages associated with these prior structures.

More specifically, it is an object of this invention to provide:

1. An improved shot sleeve assembly which includes an improved cooling system associated therewith for permitting increased life of the shot sleeve and minimization of thermally induced failures such as cracking and the like.

2. A shot sleeve assembly, as aforesaid, which provides for more uniform cooling of the shot sleeve assembly to thereby make same more compatible with the cooled plunger tip, whereby a more uniform and controlled clearance is maintained between the tip and the shot sleeve during operation.

3. A shot sleeve assembly, as aforesaid, which provides for more controlled cooling of the shot sleeve assembly to prevent, or substantially minimize, thermally induced distortion of the shot sleeve assembly, both circumferentially and axially, thereby minimizing both thermal cracking and wear.

4. A shot sleeve assembly, as aforesaid, which provides an inner sleeve or liner for receiving the molten metal and an outer sleeve through which circulates the coolant, whereby the thermal gradients within the inner sleeve can be minimized and at the same time provide for more uniform extraction of heat from the inner sleeve both circumferentially and axially thereof.

5. A shot sleeve assembly, as aforesaid, which permits the inner sleeve to be constructed of a hardened and tempered steel capable of withstanding the hot molten metal, while at the same time permitting the outer sleeve to be of a milder and more tempered steel capable of being readily machined so as to accommodate the necessary cooling passages therein.

6. A shot sleeve assembly, as aforesaid, which due to its concentric sleeve arrangement provides for more controlled extraction of heat from the inner sleeve to thereby avoid excessive cooling of the molten metal, while at the same time permitting the molten metal to be supplied to the sleeve at a minimum temperature to avoid or minimize the tempering of the inner sleeve opposite the pour hole, whereby errosion of the material opposite the pour hole is likewise minimized.

7. A shot sleeve assembly, as aforesaid, which increases the life of both the inner sleeve and the tip member several times in contrast to prior structures, and at the same time provides a more uniform and controlled clearance between the tip member and the inner sleeve to minimize the possibility of material blow-by and also minimize the possibility of air entering into the molten metal and causing porous castings.

8. A shot sleeve assembly, as aforesaid, which greatly facilitates maintenance and/or replacement of the shot sleeve by permitting the inner sleeve to be removed and/or replaced on the machine without requiring removal of the die assembly.

9. A shot sleeve assembly, as aforesaid, which permits the inner sleeve to be slidably removed from the outer cooling sleeve without requiring demounting of the cooling sleeve from the platen, and which permits the inner shot sleeve to be slidably removed from the back or rearward side of the platen.

10. A shot sleeve assembly, as aforesaid, wherein a slight clearance exists between the inner and outer sleeves when they are substantially at the same temperature, such as ambient temperature, to permit (1) the inner sleeve to be easily slidably removed from the outer sleeve, (2) the minimization of thermal stresses and distortions in both of the sleeves due to the permitted thermal expansion of the inner sleeve prior to engagement with the outer sleeve and (3) the more uniform transfer of heat from the inner sleeve to the outer sleeve due to the uniformity of engagement therebetween as caused by the initial thermal expansion of the inner sleeve.

11. A shot sleeve assembly, as aforesaid, which simplifies and greatly minimizes the maintenance and repair of the shot sleeve, which greatly minimizes the shutdown time of the die casting machine, and which greatly facilitates the interchangability of the inner sleeve.

12. A shot sleeve assembly, as aforesaid, which is readily adaptable for use in either horizontal or vertical die casting machines.

13. A shot sleeve assembly, as aforesaid, which is highly adaptable for use on a die casting machine used with automatic ladling equipment or the like to permit the machine to be operated at an increased rate per unit time, such as an hourly rate, while at the same time permitting the machine to operate for longer priods of time without requiring shutdown for maintenance and/or repair of the shot sleeve assembly.

Other objects and purposes of the invention will be apparent to persons familiar with structures of this type upon reading the following specification and inspecting the accompanying drawings.

Figure 1:
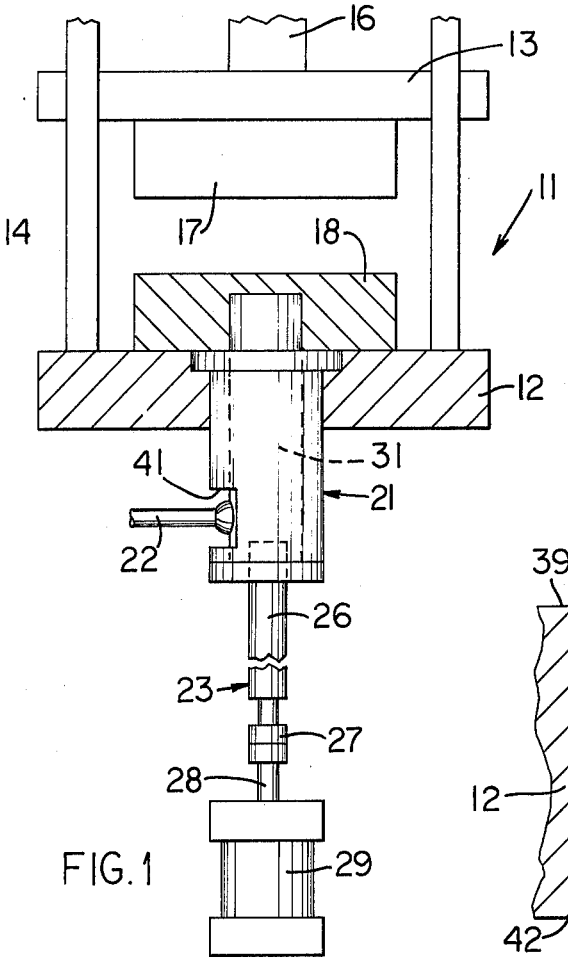
FIG. 1 is a fragmentary elevational view, partially in cross-section, illustrating a vertical die casting machine incorporating therein the improved shot sleeve assembly of the present invention.

Certain terminology will be used in the following description for convenience in reference only and will not be limiting. For example, the words "rightwardly," "leftwardly," "upwardly" and "downwardly" will refer to directions in the drawings to which reference is made. The word "forwardly" will refer to the normal flow direction of the casting material and of the coolant. The words "inwardly" and "outwardly" will refer to directions toward and away from, respectively, the geometric center of the die casting machine or shot sleeve assembly and designated parts thereof. Said terminology will include the words above specifically mentioned, derivatives thereof and words of similar import.

SUMMARY OF THE INVENTION

The objects and purposes of the present invention, including those set forth above, have been met by providing a shot sleeve assembly which includes an outer cooling sleeve adapted to be fixed to the platen of a die casting machine, and an inner shot sleeve positioned within the coooling sleeve and disposed for communication with a die assembly mounted on the platen. The inner shot sleeve has an outer diameter which is slightly less than the inner diameter of the cooling sleeve, there being for example a 0.004 inch diametrical clearance therebetween, so that the inner shot sleeve can be slidably moved into or out of the cooling sleeve when the sleeves are at ambient temperature to permit repair or replacement of the inner sleeve even though the outer sleeve is still fixedly mounted on the platen. The outer sleeve has a cooling system associated therewith which includes a plurality of axially extending flow conduits formed in the wall thereof, which flow conduits each include concentric inner and outer passages through which a coolant flows in reverse directions. When molten metal is supplied to the interior of the shot sleeve, the shot sleeve becomes heated to a relatively high temperature, whereas the cooled outer sleeve is maintained at a substantially lower temperature. The inner sleeve thus thermally expands so as to circumferentially engage the surrounding outer sleeve, thereby permitting the transfer of heat from the shot sleeve to the outer cooling sleeve. However, when nonoperational, the inner sleeve cools and contracts so as to disengage the outer sleeve, whereby the inner sleeve can be easily removed or replaced.

DETAILED DESCRIPTION

FIG. 1 illustrates a die casting machine 11, such as a conventional vertical vacuum-type die casting machine, having a stationary bottom platen 12 and a movable upper platen 13 supported for reciprocating movement on guide rods 14. An upper die 17 is mounted on the upper platen 13 and is adapted to coact with a lower die 18 which is fixedly mounted on the lower platen 12. The upper platen 13 is designed to move downwardly so that the upper die 17 matingly engages the lower die 18. For this purpose the upper platen 13 is connected to a suitable drive device, such as the reciprocating ram 16 of a conventional doubleacting fluid pressure cylinder.

To supply molding material, such as molten metal, to the die cavity, the machine 11 is provided with a shot sleeve assembly 21 mounted on the lower platen 12 and communicating with the die cavity. Molten material is supplied to the interior of the shot sleeve assembly 21 by a feed tube 22. A plunger assembly 23 is associated with the shot sleeve assembly for permitting the material to be moved upwardly into the mold cavity. The plunger assembly 23 includes an elongated plunger 26 which is connected by a coupling 27 to a reciprocating piston rod 28 associated with a conventional fluid pressure cylinder 29, which cylinder is normally of the doubleacting type. The forward end (that is, the upper end in FIGS. 1 and 2) of the plunger 26 is provided with a tip member which is slidably disposed within the inner sleeve 31 and is used for injecting the molten metal into the die cavity. This tip member is cooled by having a coolant such as water circulate therethrough. The structure of the tip member and the manner in which it is cooled is conventional, being disclosed in above-mentioned U.S. Pat. No. 3,209,416.

Considering now the shot sleeve assembly 21, same includes an elongated inner shot sleeve 31 having a bore 32 extending therethrough. A feed opening or pouring hole 33 extends through the sidewall of the shot sleeve 31 adjacent the lower end thereof. The upper end of the shot sleeve 31 extends into the die 18 so that the bore 32 communicates with the die cavity.

An outer cooling sleeve or bushing 36 is disposed in concentric surrounding relationship to the shot sleeve 31, which outer sleeve 36 is positioned within and extends through an annular bore 37 formed in the platen 12. The cooling sleeve 36 has an annular flange 38 fixedly, here integrally, connected to one end thereof. Flange 38 is received within a suitable recess formed in the platen 12 for properly seating and retaining the outer cooling sleeve 36 in the platen so that the upper end of the sleeve is substantially flush with the upper surface 39. The outer cooling sleeve 36 has an enlarged recess 41 extending through the sidewall thereof, which recess is located adjacent the lower end of the sleeve and extends only part way around the circumferential extent thereof so that the feed opening 33 is exposed. The recess 41 is spaced downwardly from the rear surface 42 of the platen so as to permit the desired access to the feed opening 33.

According to the present invention, the outer peripheral surface 43 of the inner shot tube 31 is defined by a diameter which is slightly less than the diameter of the inner circumferential surface 44 of the outer cooling sleeve 36 when the two sleeves are at the same temperature, such as ambient temperature, whereby a clearance exists between these sleeves through the axial length therebetween. The diametrical clearance between the surfaces 43 and 44 is, in a preferred embodiment of the invention, approximately 0.004 inch. However, this diametrical clearance may range from a minimum of approximately 0.002 inch to a maximum of approximately 0.010 inch. The purpose of this diametrical clearance will be explained hereinafter.

The outer cooling sleeve 36 is nonrotatably secured with respect to the inner shot sleeve 31. For this purpose, the inner shot sleeve 31 has a projecting annular flange 46 fixedly, here integrally, connected to the lower end thereof, which flange is disposed directly adjacent and projects outwardly so as to overlap the lower end of the cooling sleeve 36. A locking pin 47 is fixed, as by being press fit, to the cooling sleeve 36 and projects downwardly into a slot formed in the flange 46 for nonrotatably coupling the sleeves 31 and 36 together.

To permit cooling of the shot sleeve assembly 21, the outer sleeve 36 is provided with a pair of cooling passages 48 and 49 extending internally therethrough, which cooling passages permit the flow of a suitable coolant, such as water, through the outer sleeve 36. In the illustrated embodiment, the cooling passages 48 and 49 are substantially identical, and thus only the passage 48 will be described in detail.

Figure 2:
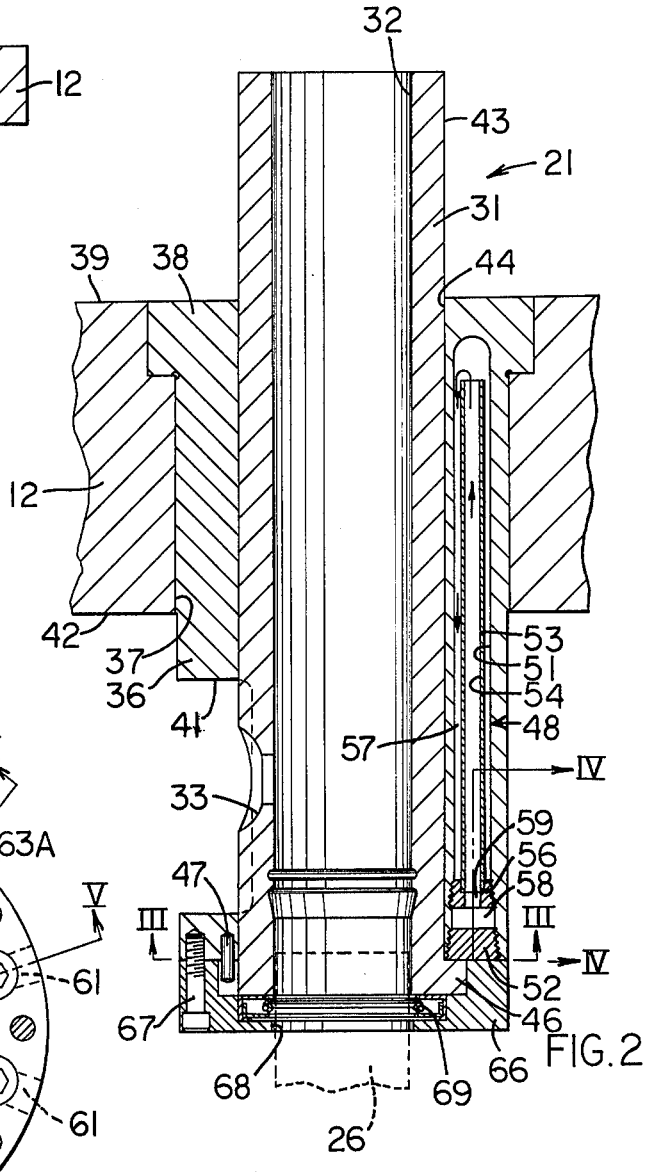
FIG. 2 is an enlarged sectional view of the shot sleeve assembly taken along the line II—II in FIG. 3.

Considering the cooling passage 48, same includes a plurality of elongated and substantially parallel bores 51 formed in and extending axially of the sidewall of the cooling sleeve 36. As illustrated in FIG. 2, wherein one such bore 51 is illustrated, the bore 51 extends throughout substantially the complete length of the sleeve 36 and is disposed substantially parallel to the axis of the sleeve.

The upper end of the bore 51 terminates short of the upper end of the sleeve, and the lower end of the bore 51 is sealingly closed by means of a threaded plug 52. An elongated tube 53 is disposed within the bore 51 and extends axially thereof in substantially concentric relationship with the bore, which tube 53 has the upper end thereof terminating short of the upper end of the bore 51, whereby the bore or passage 54 formed by the tube 53 is thus in open communication with the upper end of the bore 51. The lower end of the tube 53 is suitably fixedly and sealingly seated within a further plug 56, which plug is also threadably and sealingly engaged with the sidewall of the bore 51. The tube 53 is of smaller diameter than the bore 51 so as to define an annular passageway 57 in surrounding relationship to the tube 53.

The plug 56 is spaced upwardly from the plug 52 so as to define a small chamber 58 therebetween. The chamber 58 is in open communication with the passage 54 defined within the interior of the tube 53 due to the presence of a connecting passage 59 formed in the plug 56.

Figure 4:
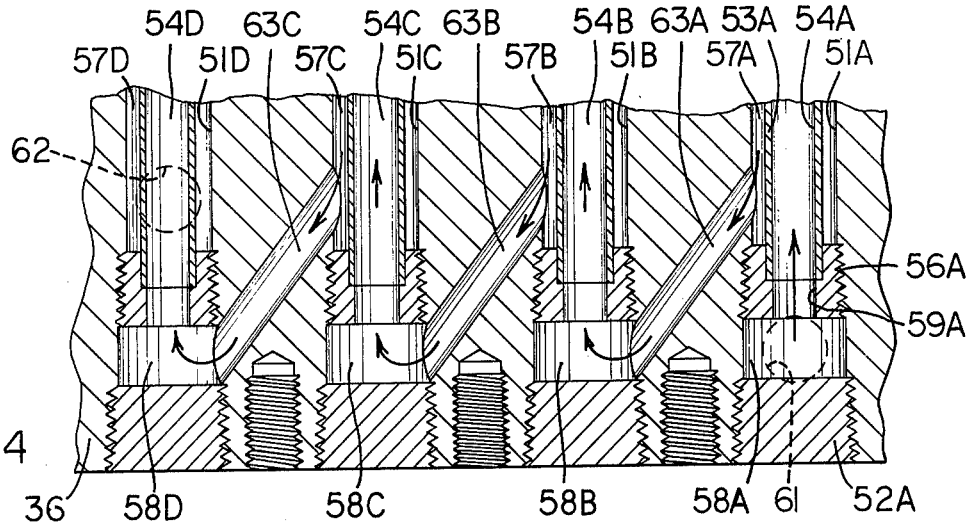
FIG. 4 is an enlarged, fragmentary sectional view taken along line IV—IV in FIG. 2.

As previously noted, the outer cooling sleeve 36 contains therein a plurality of parallel bores 51 associated with the cooling passage 48. In one embodiment of the invention, as illustrated in FIG. 4, cooling sleeve 36 has four such bores 51 formed therein and extending axially thereof, which bores have been designated as 51A, 51B, 51C and 51D in FIG. 4 for purposes of identification.

Figure 5:
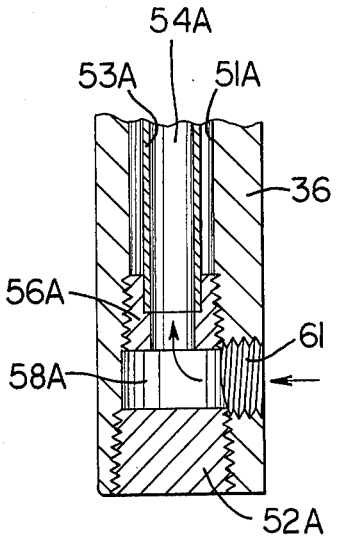
FIG. 5 is an enlarged, fragmentary sectional view taken along line V—V in FIG. 3.
Figure 6:
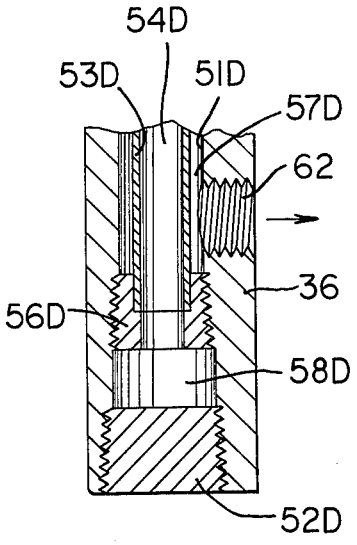
FIG. 6 is an enlarged, fragmentary sectional view taken along line VI—VI in FIG. 3.

The cooling passage 48 is provided with an inlet opening 61 which extends radially into the wall of the sleeve 36 for communication with the bore 51A. The inlet opening 61, as illustrated in FIGS. 4 and 5, is positioned to communicate directly with the chamber 58A. Cooling passage 48 also has an outlet opening 62 formed radially in the sidewall of the sleeve 36, which opening 62 communicates with the bore 51D. The outlet opening 62, as illustrated in FIGS. 4 and 6, is positioned to communicate with the bore 51D at a location disposed directly above the plug 56D, whereby the outlet opening 62 thus communicates with the lower end of the annular passage 57D.

To provide communication between the adjacent parallel bores 51A, 51B, 51C and 51D, the sleeve 36 is additionally provided with intermediate connecting passages 63A, 63B and 63C formed therein. As illustrated in FIG. 4, the passage 63A has one end thereof communicating with the lower end of the passage 57A, whereas the other end of passage 63A communicates with the chamber 58B associated with the next adjacent bore. The passage 63B in turn has one end thereof communicating with the lower end of the annular passage 57B whereas the other end of passage 63B communicates with the chamber 58C as associated with the next adjacent bore. The connecting passage 63C in turn has one end thereof communicating with annular passage 57C and the other end communicating with the chamber 58D.

The cooling passage 49 is substantially identical to the cooling passage 48 in that it also includes a plurality of axially extending bores which define concentric passages for permitting counterflow of coolant. Passage 49 also has inlet and outlet openings 61 and 62 associated with the opposite ends thereof. The coolant, such as water, is supplied to both of the inlet openings 61 in a conventional manner and is likewise discharged from the outlet openings 62 into suitable drain conduits or the like.

Figure 3:
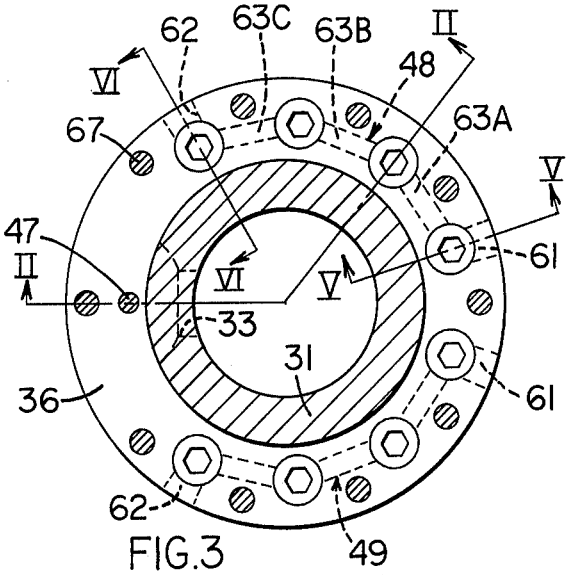
FIG. 3 is a sectional view taken along the line III—III in FIG. 2.

As illustrated in FIG. 3, each of the cooling passages 48 and 49 extend circumferentially of the sleeve 36 over a substantial arcuate extent, whereby effective cooling of the sleeve 36 is achieved throughout a majority of the circular extent thereof. While the present invention illustrates the use of two substantially identical passages 48 and 49 extending circumferentially and axially of the sleeve 36 for cooling same, it will be recognized that the number of such passages can be selectively varied as necessary in order to provide for optimum cooling. Still further, while the present invention illustrates the use of four bores 51 associated with each cooling passage 48 and 49, it will be appreciated that the number of such bores 51 can also be suitably varied depending upon the size, geometry and heat characteristics, so as to result in optimum cooling of the sleeve.

OPERATION

The operation of the present invention will be briefly described to ensure a complete understanding thereof.

When the die casting machine 11 is to be utilized, the drive device associated with the ram 16 is energized to move the platen 13 downwardly until the upper die 17 engages the lower die 18, thereby closing off the cavity. When in this condition, the plunger 26 is in its lowermost of retracted position as illustrated in FIG. 1.

The molten material, such as aluminum or magnesium, is then supplied through the feed tube 22 into the bore 32 defined by the shot sleeve 31. When an appropriate quantity of molten material has been supplied to the shot sleeve, then the plunger 26 is moved upwardly and the material fills the mold cavity.

During the operation of the die casting machine, as described above, the molten metal as supplied to the shot sleeve 31 is at an extremely high temperature, such as 1250° F, so that the shot sleeve absorbs a substantial amount of heat and accordingly undergoes substantial thermal expansion. However, as previously discussed, the outer diameter 43 of the shot sleeve 31 is slightly smaller than the inner diameter 44 of the cooling sleeve 36. Thus, when the shot sleeve 31 thermally expands, it will undergo sufficient expansion as to move into secure metal-to-metal engagement with the cooling sleeve 36. When this happens, the heat from in the shot sleeve 31 is then transferred to the cooling sleeve 36, which heat to a great degree is then transferred to the coolant which is flowing through the passages 48 and 49. Thus, even though the shot sleeve 31 is initially smaller than the sleeve 36, nevertheless the initial heating of the sleeve 31 results in same expanding into engagement with the sleeve 36 so as to achieve the desirable heat transfer from the sleeve 31 to the sleeve 36. At the same time, the sleeve 36 is continuously cooling, and thus does not experience as much thermal expansion as the shot sleeve 31. The initial clearance between the two sleeves thus compensates for the differential thermal expansion which exists between the sleeves 31 and 36. The thermal stresses imposed on sleeve 31 due to the surrounding sleeve 36 are thus substantially minimized, thereby greatly increasing the life of the sleeve 31 and minimizing the possibility of thermal cracking thereof. This desired cooling of inner sleeve 31 not only minimizes the thermal expansion of this sleeve, but also effectively prevents (or at least greatly minimizes) any thermal distortion of the sleeve which would cause it to assume an out-of-round shape, so that a more uniform clearance is thus maintained between the inner sleeve and the slidable plunger tip. This thus greatly minimizes the wear of the tip and also minimizes the possibility of hot molten metal being blown backwardly past the tip into the surrounding environment.

When maintenance or replacement of the sleeve 31 is desired, the machine 11 is deactivated and the shot sleeve is permitted to cool back to ambient temperature, whereby the sleeve 31 contracts to its original configuration so that the outer surface 43 is of slightly smaller diameter than the inner surface 44 of the cooling sleeve 36. This diametrical clearance between the sleeves 31 and 36 thus permits the sleeve 31 to be easily slidably removed from the sleeve 36. For this purpose, the plunger 26 can be suitably removed from the shot sleeve assembly, as by disconnecting the plunger or by demounting the driving cylinder, whereupon the retaining cap 66 can likewise be disconnected from the lower end of the cooling sleeve 36 by removal of the screws 67. This thus permits the inner shot sleeve 31 to be easily slidably removed from the outer cooling sleeve 36 without requiring any disconnection of the cooling sleeve 36 from the platen 12 and without requiring demounting of the lower die 18 from the platen 12.

With respect to the flow of coolant through the passages 48 and 49, reference is made to FIGS. 4–6. The coolant, such as water, is supplied through the inlet opening 61 into the chamber 58A associated with the bore 51A. The coolant flows upwardly through the passage 54A and, after being discharged at the upper end of the tube 53A, flows downwardly in surrounding relationship to the tube 53A through the annular passage 57A. Upon reaching the lower end of passage 57A, the coolant flows through the connecting passage 63A into the chamber 58B. The coolant again flows upwardly through the passage 54B and then downwardly through the surrounding annular passage 57B until flowing through the connecting passage 63B for supply to the chamber 58C. In the same manner, the fluid then flows upwardly through passage 54C and then downwardly through the surrounding annular passage 57C, from which the fluid then flows through connecting passage 63C to chamber 58D and then again upwardly through passage 54D. The fluid discharged from the upper end of the passage 54D flows downwardly through the surrounding annular passage 57D and is then discharged through the outlet opening 62. Thus, within each of the bores 51, the coolant first flows through the center of a cooling tube in one direction and then flows around the outside of the tube in the opposite direction, and is then sequentially transferred and flows through a further plurality of identical flow tube arrangements. In this manner, the water of lowest temperature is initially maintained from direct engagement with the cooling sleeve so as to minimize thermal stress within the cooling sleeve and yet at the same time prevent the creation of hot spots.

The cooling system as provided in association with the shot sleeve is, in the illustrated embodiment, highly desirable since it provides for maximum cooling at the higher heat areas and less cooling in the lower heat areas so as to result in a more uniform temperature circumferentially around the sleeve. For example, the inlet openings 61 for the coolant are disposed substantially directly opposite the pour hole 33. Since the wall of the liner directly opposite the pour hole is initially contacted by the hot molten metal as supplied to the shot sleeve, this area of the liner in the vicinity of the inlet openings 61 is thus subject to maximum heating. On the other hand, as the coolant flows from the openings 61 through the intermediate passages and is then discharged through the openings 62, the coolant tends to heat up but at the same time the liner is subject to less heat so that the coolant is thus required to extract less heat from the liner. In this way, the extraction of heat is somewhat proportional to the heat loads imposed on the liner, and the net result is that a more uniform temperature exists circumferentially around the liner and this accordingly minimizes the tendency for the liner to distort into an out-of-round condition.

While FIG. 3 illustrates the two cooling passages 48 and 49 as extending over a majority of the circumferential extent of the liner, it will be appreciated that these cooling passages could be extended even further so as to extend over substantially all of the circumferential extent of the liner. For example, each of the passages 48 and 49 could be extended circumferentially by being provided with still an additional bore 51 located in the arcuate region between the adjacent bolt 67 and the pin 47 substantially as shown on the left side of FIG. 3, which additional bores would extend axially through that region of the outer sleeve 36 located directly above the opening 41 so that the outer sleeve 36 would thus be effectively cooled throughout the complete circular extent thereof.

Of additional significance is the fact that each of the passages 48 and 49, as they extend between the respective inlet opening 61 and respective outlet opening 62, defines a single series-connected flow path for the coolant. Thus, by monitoring the flow of fluid into or out of each of these passages, and by ensuring proper flow through these passages, it is thus easy to determine that the areas of the sleeve are being properly cooled and that none of the internal passages are plugged which would prevent flow therethrough and create a hot spot in the sleeve. Thus, forming the interior passages of the sleeve in a series arrangement, rather than a parallel arrangement, is desirable in order to prevent internal plugging of the passages which, when undetected, create undesirable hot spots in the sleeve.

While the accompanying drawings illustrate the improved shot sleeve assembly of the present invention for use on a vertical die casting machine, it will be appreciated that the shot sleeve assembly of the present invention is equally applicable to any type of die casting machine, including horizontal die casting machines.

It will be appreciated that the design of the cooling passages within the outer sleeve 36 could vary substantially from that shown in the drawing without departing from the essential aspects of the present invention. Further, the outer cooling sleeve 36 is constructed as an integral one-piece annular member in order to provide it with sufficient strength to withstand the thermal stresses developed therein during operation of the die casting machine. This is of significance in order to prevent cracking of this outer cooling sleeve, even though the thermal stresses developed in this cooling sleeve are substantially less than those experienced in prior structures due to the improvements of the present invention. The inner sleeve or liner is similarly constructed as an integral one-piece annular member for substantially the same reasons.

Although a particular preferred embodiment of the invention has been disclosed in detail for illustrative purposes, it will be recognized that variations or modifications of the disclosed apparatus, including the rearrangement of parts, lie within the scope of the present invention.

I claim:

1. A shot sleeve assembly for a die casting machine, comprising:

an outer cooling sleeve adapted to be fixedly mounted on a platen of a die casting machine, said cooling sleeve comprising an integral one-piece annular member, and an elongated shot sleeve disposed concentrically within said outer cooling sleeve, said shot sleeve also comprising an integral one-piece annular member, said cooling sleeve and said shot sleeve having a small diametrical clearance therebetween which extends axially throughout the complete axial length between said sleeves when they are both at ambient temperature;

said shot sleeve having an elongated bore extending therethrough for receiving therein a high temperature casting material, an inlet opening formed in the sidewall of the shot sleeve adjacent one end thereof for permitting said casting material to be deposited into said bore, and a plunger slidably supported within the bore of said shot sleeve; and said cooling sleeve having cooling means associated therewith for permitting extraction of heat from said shot sleeve, said cooling means comprising a plurality of axially extending passage means extending over a majority of both the axial and circular extent of said cooling sleeve for permitting circulation of a liquid coolant therethrough to cause extraction of heat from said shot sleeve over a majority of the axial length and circular extent thereof, said passage means being formed totally interiorly of said cooling sleeve between the inner end outer annular surfaces thereof so that the coolant flowing through said passage means is confined solely by said cooling sleeve and does not directly contact the shot sleeve, and said cooling sleeve having inlet and outlet opening means formed therein and communicating with said passage means for respectively permitting liquid coolant to be supplied thereto and extracted therefrom.

2. A shot sleeve assembly according to claim 1, wherein said plurality of passage means includes a plurality of separate passages formed interiorly of said cooling sleeve and joined together in series by intermediate passages so as to define a substantially sinusoidal flow path which extends both axially and circumferentially of said cooling sleeve over a majority of both the axial length and circumferential extent thereof.

3. A shot sleeve assembly according to claim 1, wherein said shot and cooling sleeves are disposed substantially vertically.

4. A shot sleeve assembly according to claim 1, wherein said inlet opening means is formed in said cooling sleeve for communication with said passage means substantially diametrically opposite from the inlet opening in said shot sleeve, and said outlet opening means being formed in said cooling sleeve for communication with said passage means at a location which is circumferentially displaced from said inlet opening means and is disposed more closely adjacent the inlet opening of said shot sleeve.

5. A shot sleeve assembly according to claim 4, wherein said passage means includes a plurality of separate passages formed interiorly of said cooling sleeve and joined together in series by intermediate passages so as to define a substantially sinusoidal flow path which extends both axially and circumferentially of said cooling sleeve over a majority of both the axial length and circumferential extent thereof.

6. A shot sleeve assembly according to claim 1, wherein the plunger is constructed of a material which is different from and softer than the material of the shot sleeve, and wherein the plunger is internally cooled.

7. An improved shot sleeve assembly for a die casting machine, comprising an elongated integral one-piece shot sleeve adapted to have a quantity of a high temperature casting material deposited therein, said shot sleeve having a feed opening formed through the sidewall thereof and disposed adjacent one end of said shot sleeve, a plunger slidably disposed within the shot sleeve, and an elongated integral one-piece cooling sleeve disposed in surrounding relationship to said shot sleeve, said cooling sleeve being adapted to be fixedly mounted on a platen and having cooling passage means formed therein for permitting circulation of a liquid coolant therethrough, said cooling sleeve having a bore therethrough in which is accommodated said shot sleeve, said cooling sleeve having an inner diameter which is in the range of 0.002 to 0.010 inch larger than the outer diameter of said shot sleeve so as to define a diametrical clearance space which extends throughout the complete axial length between said sleeves when they are both at ambient temperature, whereby depositing of high temperature casting material into said shot sleeve causes the temperature thereof to substantially increase so that said shot sleeve expands into engagement with said cooling sleeve to permit heat transfer from said shot sleeve to said cooling sleeve, said cooling passage means including a plurality of elongated and substantially parallel cooling bores disposed in angularly spaced relationship around said cooling sleeve throughout a majority of the circular extent thereof, said bores extending axially from a location disposed adjacent one end of said cooling sleeve to a location disposed adjacent the other end thereof, said cooling passage means also including inlet and outlet openings formed in said cooling sleeve adjacent said one end thereof and communicating with different ones of said elongated bores, and flow control means associated with each said cooling bore for defining concentric inner and outer flow paths to permit coolant to flow axially of said cooling bore first in one axial direction along one of said paths and then in the opposite axial direction along the other of said paths, said flow control means including an elongated tubular member disposed concentrically within said cooling bore and extending over a major portion of the length thereof, said tubular member being of small diameter than said cooling bore so as to define said one path through the interior thereof and said other path in surrounding relationship thereto, said two paths being in open communication with one another adjacent only one end of said tubular member.

8. A shot sleeve assembly for a die casting machine, comprising an outer cooling sleeve adapted to be fixedly mounted on a platen of a die casting machine, said cooling sleeve comprising an integral one-piece tubular member, an elongated one-piece shot sleeve disposed concentrically within said outer cooling sleeve and nonrotatably coupled thereto, said cooling sleeve and said shot sleeve having a small diametrical clearance therebetween which extends throughout the complete axial length between said sleeves when they are both at ambient temperature, said shot sleeve having an elongated bore extending therethrough and adapted to receive therein a high temperature molten material, a plunger slidably supported within the bore of said shot sleeve, an inlet opening formed in the sidewall of said shot sleeve adjacent one end thereof for permitting said high temperature molten material to be supplied into said bore, an opening formed in the sidewall of said cooling sleeve and positioned so as to overlie said inlet opening, first and second cooling means associated with said outer cooling sleeve for permitting circulation of a liquid coolant through the sidewall thereof, said first and second cooling means respectively including a first and second plurality of elongated and substantially parallel cooling bores formed within the sidewall of said cooling sleeve and extending axially from a location adjacent one end thereof to a location disposed adjacent the other end thereof, said cooling bores of said first and second cooling means being angularly spaced around said cooling sleeve throughout a major portion of the circular extent thereof whereby said cooling bores extend from a location disposed adjacent one side of said inlet opening circumferentially around said sleeve to a location disposed adjacent the other side of said inlet opening, first and second intermediate passage-means formed in said cooling sleeve adjacent an end thereof for providing communication between the adjacent cooling bores of said first and second cooling means respectively so that the coolant sequentially flows through the adjacent cooling bores, said first plurality of cooling bores extending circumferentially of the shot sleeve from a location disposed substantially diametrically opposite from the inlet opening to a location disposed adjacent one side of the inlet opening, said second plurality of cooling bores extending from a location substantially diametrically opposite the inlet opening to a location adjacent the other side of the inlet opening, first and second inlet opening means connected to ones of said cooling bores associated with said first and second cooling mean respectively as disposed diametrically opposite said inlet opening, and first and second outlet opening means connected to ones of said cooling bores associated with said first and second cooling means respectively as disposed directly adjacent the opposite sides of said inlet opening.

* * * * *

UNITED STATES PATENT AND TRADEMARK OFFICE

CERTIFICATE OF CORRECTION

PATENT NO. : 4 086 953

DATED : May 2, 1978

INVENTOR(S) : David M. Kraklau

It is certified that error appears in the above–identified patent and that said Letters Patent are hereby corrected as shown below:

Column 14, Line 28; Please change "end" to ---and---.

Column 15, Line 45; Please change "small" to ---smaller---.

Signed and Sealed this

*Tenth* Day of *October 1978*

[SEAL]

*Attest:*

RUTH C. MASON
*Attesting Officer*

DONALD W. BANNER
*Commissioner of Patents and Trademarks*